US007879287B2

(12) United States Patent
Kobayashi et al.

(10) Patent No.: US 7,879,287 B2
(45) **Date of Patent: *Feb. 1, 2011**

(54) HOT-ROLLED STEEL SHEET FOR HIGH-STRENGTH ELECTRIC-RESISTANCE WELDED PIPE HAVING SOUR-GAS RESISTANCE AND EXCELLENT WELD TOUGHNESS, AND METHOD FOR MANUFACTURING THE SAME

(75) Inventors: Takashi Kobayashi, Chiyoda-ku (JP); Hiroshi Nakata, Chiyoda-ku (JP); Chikara Kami, Chiyoda-ku (JP); Toru Inazumi, Chiyoda-ku (JP); Shuji Kawamura, Chiyoda-ku (JP)

(73) Assignee: JFE Steel Corporation (JP)

( * ) Notice: Subject to any disclaimer, the term of this patent is extended or adjusted under 35 U.S.C. 154(b) by 493 days.

This patent is subject to a terminal disclaimer.

(21) Appl. No.: 11/049,836

(22) Filed: Feb. 3, 2005

(65) Prior Publication Data

US 2005/0183798 A1 Aug. 25, 2005

(30) Foreign Application Priority Data

Feb. 24, 2004 (JP) ..... 2004-047162

(51) Int. Cl.

| | |
|---|---|
| ***C22C 38/60*** | (2006.01) |
| ***C22C 38/14*** | (2006.01) |
| ***C22C 38/12*** | (2006.01) |
| ***C22C 38/00*** | (2006.01) |
| ***C21D 9/08*** | (2006.01) |
| ***C21D 9/52*** | (2006.01) |
| ***C21D 8/02*** | (2006.01) |

(52) U.S. Cl. ..... 420/84; 420/85; 420/126; 420/127; 148/320; 148/593; 148/602

(58) Field of Classification Search ..... 148/320, 148/330, 332, 593, 602; 420/8, 84, 85, 126, 420/127

See application file for complete search history.

(56) References Cited

U.S. PATENT DOCUMENTS 5,948,183 A * 9/1999 Okada et al. ..... 148/330

FOREIGN PATENT DOCUMENTS

| | | | |
|---|---|---|---|
| EP | 0 733 715 A | | 9/1996 |
| JP | 57 005819 A | | 1/1982 |
| JP | 60 067618 A | | 4/1985 |
| JP | 61 157628 A | | 7/1986 |
| JP | 06256842 A | * | 9/1994 |
| JP | 7-70697 | | 3/1995 |
| JP | 07 173536 A | | 7/1995 |
| JP | 08 283906 A | | 10/1996 |
| JP | 9-296216 | | 11/1997 |
| JP | 09 296216 A | | 11/1997 |

OTHER PUBLICATIONS

Stefanescu et al., ASM Handbook, Solidification Structures of Steels and Cast Irons-Steel-Microstructure, 2004, ASM International, vol. 9, p. 97-106.*

* cited by examiner

*Primary Examiner*—Roy King
*Assistant Examiner*—Caitlin Fogarty
(74) *Attorney, Agent, or Firm*—DLA Piper LLP (US)

(57) ABSTRACT

A hot-rolled steel sheet for high-strength ERW pipes contains about 0.02% to about 0.06% C; about 0.05% to about 0.50% Si; about 0.5% to about 1.5% Mn; about 0.010% or less P; about 0.0010% or less S; about 0.01% to about 0.10% Al; about 0.01% to about 0.10% Nb; about 0.001% to about 0.025% Ti; about 0.001% to about 0.005% Ca; about 0.003% or less 0; and about 0.005% or less N, and at least one element selected from the group consisting of about 0.01% to about 0.10% V; about 0.01% to about 0.50% Cu; about 0.01% to about 0.50% Ni; and about 0.01% to about 0.50% Mo on the basis of mass. The group of C, Si, Mn, Cu, Ni, Mo, and V and the group of Ca, 0, and S satisfy specific relationships, and the microstructure of the steel sheet is composed of about 95% by volume or more bainitic ferrite.

9 Claims, 2 Drawing Sheets

HOT-ROLLED STEEL SHEET FOR HIGH-STRENGTH ELECTRIC-RESISTANCE WELDED PIPE HAVING SOUR-GAS RESISTANCE AND EXCELLENT WELD TOUGHNESS, AND METHOD FOR MANUFACTURING THE SAME

RELATED APPLICATION

This application claims priority of Japanese Patent Application No. JP 2004-047162, with a filing date of Feb. 24, 2004.

BACKGROUND

1. Technical Field

This disclosure relates to hot-rolled steel sheets for high-strength electric-resistance welded (ERW) pipes having sour-gas resistance and excellent weld toughness suitable for line pipes utilized for transportation of oil, natural gas, or the like, and methods for manufacturing the same.

2. Description of the Related Art

Steel pipes are industrial materials indispensable for extraction and transportation of oil and natural gas. Welded pipes such as UOE pipes and ERW pipes are widely employed as line pipes for mass transportation of extracted oil and natural gas from places of production such as oil wells and gas wells to places of demand or places of shipping. There is growing demand for high-strength welded pipes having resistance to high-pressure transportation to improve the transport efficiency of pipelines.

Since UOE pipes are manufactured from thick steel plates, the pipes can be made strong and thick with relative ease. These UOE pipes are widely prevailing as line pipes. Meanwhile, since ERW pipes are manufactured by electric-resistance welding thin steel sheets such as hot-rolled steel sheets, the manufacturable dimension is limited in a range to a relatively small diameter with a thin wall. However, ERW pipes have higher productivity than UOE pipes, and can be manufactured at a lower cost. Accordingly, UOE pipes are being replaced with ERW pipes in a dimensional range that enables the use of UOE pipes and ERW pipes. For example, such a dimensional range is 12.7 mm or more in thickness.

Oil and natural gas extracted from oil fields and gas fields that have recently been developed include a large amount of $H_2S$. Welded pipes for pipelines utilized for the transportation of the oil and the natural gas are thus exposed to a so-called "sour environment." Therefore, resistance to hydrogen-induced cracking (HIC) caused by $H_2S$ is increasingly required for such pipes.

As a material for the high-strength ERW pipes which meets the above-described demand, a high-strength hot-rolled steel strip having an excellent HIC resistance and a method for manufacturing the same are disclosed in, for example, Japanese Unexamined Patent Application Publication No. 07-070697. The microstructure of the hot-rolled steel strip is composed of substantially uniform polygonal ferrite produced by adding an appropriate amount of Ti to carbon steel containing 0.04% to 0.18% C by mass. Moreover, a method for manufacturing a high-strength hot-rolled steel sheet having an excellent HIC resistance is disclosed in Japanese Unexamined Patent Application Publication No. 09-296216. The microstructure of the hot-rolled steel sheet is composed of a single phase of bainite produced by adding an appropriate amount of Ti, Nb, and Ca to carbon steel containing 0.01% to 0.12% C by mass, and by hot-rolling the steel under predetermined conditions for rolling and cooling.

In the technique disclosed in Japanese Unexamined Patent Application Publication No. 07-070697, a steel strip having a microstructure of a single phase of polygonal ferrite is produced by means of TiC precipitation. The absence of a hard second phase in steel leads to a reduction in HIC and advantageously improves HIC resistance. However, the toughness of the steel having the microstructure of the single phase of polygonal ferrite is disadvantageously very low. Since oil fields and gas fields that have recently been developed are often located in extremely cold regions in high latitudes, steel pipes for line pipes laid in these regions require excellent low-temperature toughness. Therefore, the hot-rolled steel strip disclosed in Japanese Unexamined Patent Application Publication No. 07-070697 does not have sufficient toughness as a material for ERW pipes for line pipes.

The technique disclosed in Japanese Unexamined Patent Application Publication No. 09-296216 removes the influence of nonmetallic inclusions by optimizing the amount of added Ca, makes the steel microstructure uniform by rendering it a single phase of bainite, and reduces crack sensitivity to HIC. However, in the method disclosed in Japanese Unexamined Patent Application Publication No. 09-296216, hot rolling is finished at a high temperature exceeding ($Ar_3$ transformation temperature+100° C.). This technique conflicts with the controlled rolling that is generally utilized for imparting high strength and high toughness to the steel sheet. Consequently, the steel sheet produced by this technique does not have sufficient toughness.

ERW pipes require excellent toughness not only at the pipe body, i.e. the base metal, but also at the pipe seam, i.e. the weld. Moreover, since ERW pipes for line pipes are welded over 360 degrees at connecting portions at the site where the pipelines are laid, ERW pipes also require excellent toughness around the whole circumferential weld.

SUMMARY

We found that the strength, toughness, and HIC resistance of hot-rolled steel sheets and their welds can be significantly improved by adjusting the composition and microstructure of the steel sheets in a predetermined range.

Thus, we provide hot-rolled steel sheets for high-strength ERW pipes having sour-gas resistance and excellent weld toughness containing about 0.02% to about 0.06% C; about 0.05% to about 0.50% Si; about 0.5% to about 1.5% Mn; about 0.010% or less P; about 0.0010% or less S; about 0.01% to about 0.10% Al; about 0.01% to about 0.10% Nb; about 0.001% to about 0.025% Ti; about 0.001% to about 0.005% Ca; about 0.003% or less O; and about 0.005% or less N, and at least one element selected from the group consisting of about 0.01% to about 0.10% V; about 0.01% to about 0.50% Cu; about 0.01% to about 0.50% Ni; and about 0.01% to about 0.50% Mo on the basis of mass. Furthermore, the hot-rolled steel sheets are characterized in that C, Si, Mn, Cu, Ni, Mo, and V satisfy Px given by Relationship 1:

$$Px=(C)+(Si)/30+((Mn)+(Cu))/20+(Ni)/60+(Mo)/7+(V)/10\leqq 0.17 \quad (1)$$

where (M) indicates the content by mass percent of an element M;

Ca, O, and S satisfy Py given by Relationship 2:

$$Py=\{(Ca)-(130\times(Ca)+0.18)\times(O)\}/(1.25\times(S))$$
$$1.2\leqq Py\leqq 3.6 \quad (2)$$

where (M) indicates the content by mass percent of an element M;

the balance is Fe and incidental impurities; and the microstructure of the steel sheets is composed of about 95% by volume or more bainitic ferrite.

The hot-rolled steel sheets may contain at least one element selected from the group consisting of less than about 0.1% Cr; about 0.003% or less B; and about 0.005% or less REM by mass. The hot-rolled steel sheets are characterized in that the elements of C, Si, Mn, Cu, Cr, Ni, Mo, V, and B satisfy Relationship 3:

$$Px=(C)+(Si)/30+((Mn)+(Cu)+(Cr))/20+(Ni)/60+(Mo)/7+(V)/10+(B)\times 5\leqq 0.17 \quad (3)$$

where (M) indicates the content by mass percent of an element M.

The hot-rolled steel sheets are characterized in that the ratio of Nb precipitation in the steel sheets is from about 30% to about 70% by mass with respect to the total Nb content.

Furthermore, we provide a method for manufacturing hot-rolled steel sheets for high-strength ERW pipes having sour-gas resistance and excellent weld toughness including the steps of reheating a steel slab having the above-described composition at a temperature from about 1,000° C. to about 1,300° C.; hot-rolling the slab at a finisher delivery temperature of ($Ar_3$ transformation temperature−50° C.) or more; immediately cooling the hot-rolled sheet; coiling the hot-rolled sheet at a temperature of about 700° C. or less; and slow cooling the coiled sheet.

DETAILED DESCRIPTION

Figure 1:
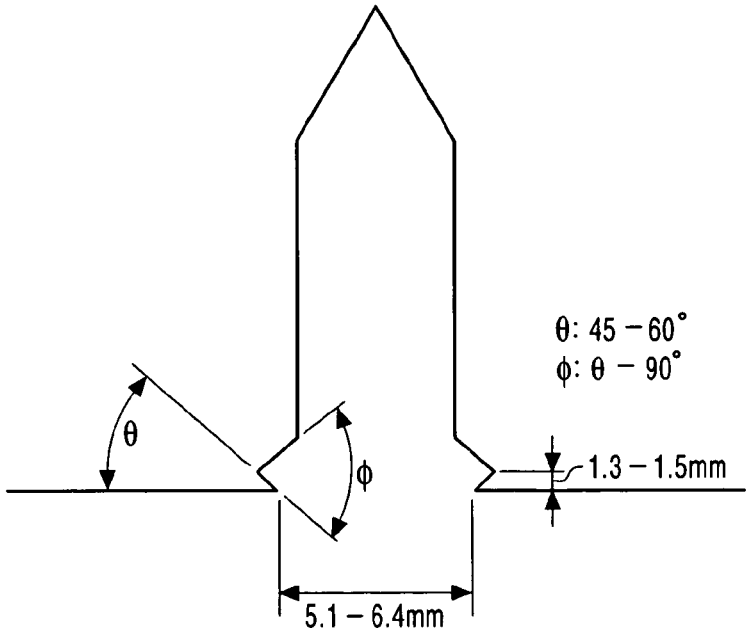
FIG. 1 illustrates the shape of the notched portion of a crack-tip-opening displacement (CTOD) test specimen.

The reasons the composition of a hot-rolled steel sheet are preferably set in the above-described range will now be described.

C: from about 0.02% to about 0.06% by mass

C is an element necessary for imparting high strength to steel. To achieve a desirable steel strength, at least about 0.02% C by mass is contained. However, when the C content exceeds about 0.06% by mass, a second phase such as pearlite can be generated in the steel microstructure which impairs toughness and hydrogen-induced cracking (HIC) resistance of the steel. Accordingly, the C content is in a range from about 0.02% to about 0.06% by mass. Preferably, the range is from about 0.03% to about 0.05% by mass.

Si: from 0.05% to 0.50% by mass

Si is an element added for deoxidizing steel. Si also improves the steel strength due to solution hardening. This effect appears when the Si content exceeds about 0.05% by mass. However, when the Si content exceeds about 0.50% by mass, the steel toughness is reduced. Accordingly, the Si content is in a range from about 0.05% to about 0.50% by mass. Preferably, the range is from about 0.10% to about 0.40% by mass.

Mn: from about 0.5% to about 1.5% by mass

Mn is an element improving the toughness and strength of steel. At least about 0.5% Mn by mass is contained. However, since excessive Mn content significantly impairs steel HIC resistance, the maximum Mn content is about 1.5% by mass. The preferable range is from about 0.8% to about 1.2% by mass.

P: about 0.010% by mass or less

P is an element existing in steel as an impurity. A large amount of P reduces the steel toughness, and also reduces steel HIC resistance due to segregation. Accordingly, the P content is about 0.010% by mass or less. More preferably, the content is about 0.008% by mass or less.

S: about 0.0010% by mass or less

S is an element existing in steel as an impurity. A large amount of S reduces toughness and also reduces steel HIC resistance due to formation of MnS. Accordingly, the S content is about 0.0010% by mass or less. More preferably, the content is about 0.0008% by mass or less.

Al: from about 0.01% to about 0.10% by mass

Al is an element added for deoxidizing steel. A sufficient deoxidizing effect is not achieved when the Al content is less than about 0.01% by mass. Meanwhile, when the Al content exceeds about 0.10% by mass, the deoxidizing effect is saturated and toughness is reduced. Accordingly, the Al content is in a range from about 0.01% to about 0.10% by mass. Preferably, the range is from about 0.02% to about 0.08% by mass.

Nb: from about 0.01% to about 0.10% by mass

Nb is an element effective in refining grains, and imparting high strength and high toughness to steel. An Nb content exceeding about 0.01% by mass is needed for these effects. However, the effects are saturated even with a large content and, moreover, material costs are increased. Accordingly, the Nb content is in a range from about 0.01% to about 0.10% by mass. Preferably, the range is from about 0.02% to about 0.08% by mass.

Ti: from 0.001% to 0.025% by mass

Ti is an element effective in refining grains, and imparting high strength and high toughness to steel. A Ti content exceeding about 0.001% by mass is needed for these effects. However, a high content exerts detrimental effects on the steel toughness due to TiC precipitation. Accordingly, the Ti content is in a range from about 0.001% to about 0.025% by mass. Preferably, the range is from about 0.005% to about 0.020% by mass.

Ca: from about 0.001% to about 0.005% by mass

Ca is an element having a property of rendering sulfides harmless by controlling the forms of the sulfides in steel. This effect can be achieved when the Ca content exceeds about 0.001% by mass. However, a Ca content exceeding about 0.005% by mass causes a reduction in toughness and HIC resistance of the steel due to Ca-based inclusions. Accordingly, the Ca content is limited in a range from about 0.001% to about 0.005% by mass. Preferably, the range is from about 0.002% to about 0.004% by mass.

O: about 0.0030% by mass or less, N: about 0.0050% by mass or less

O and N are elements incidentally contained in steel in trace amounts. Since these elements reduce toughness and HIC resistance of the steel due to the formation of inclusions, the contents of these elements are preferably small wherever possible. However, since processes for reducing the amounts of O and N in the steel cause an increase in production costs, the O content is limited to about 0.0030% by mass or less, and the N content is limited to about 0.0050% by mass or less.

In addition to the above-described elements, the hot-rolled steel sheet should contain at least one element selected from the group consisting of V, Cu, Ni, and Mo in a range described below.

V: from about 0.01% to about 0.10% by mass

V is an element having a property of imparting high strength to steel by precipitation strengthening. This effect can be achieved when the V content exceeds about 0.01% by mass. However, a high content of V impairs the toughness and the weldability of the steel. Accordingly, the V content is limited in the range from about 0.01% to about 0.10% by mass. Preferably, the range is from about 0.02% to about 0.08% by mass.

Cu: from about 0.01% to about 0.50% by mass, Ni: from about 0.01% to about 0.50% by mass, Mo: from about 0.01% to about 0.50% by mass Cu, Ni, and Mo are elements increasing the steel strength by solution hardening. Moreover, these elements have effects of improving steel hardenability, and delaying pearlitic transformation during cooling of hot-rolled steel sheets. These effects can be achieved when each of the element contents exceeds 0.01% by mass. However, high contents of these elements are not economical and impair steel weldability and the like. Accordingly, the contents of Cu, Ni, and Mo are in a range from about 0.01% to about 0.50% by mass, respectively. Preferably, the total content of these elements is about 1.0% by mass or less.

Px: about 0.17 or less

The hot-rolled steel sheet needs to contain the above-described elements of C, Si, Mn, Cu, Ni, Mo, and V so that the Px value given by Relationship 1 is 0.17 or less. The Px value indicates the crack sensitivity of welds. When the Px value exceeds 0.17, the weld toughness is significantly reduced since hardenability of the steel becomes too large. Accordingly, the Px value needs to be limited to 0.17 or less. More preferably, the Px value is 0.15 or less.

$$Px=(C)+(Si)/30+((Mn)+(Cu))/20+(Ni)/60+(Mo)/7+(V)/10\leqq 0.17 \quad (1)$$

where (M) indicates the content by mass percent of an element M.

Py: from about 1.2 to about 3.6

Furthermore, the hot-rolled steel sheet needs to contain the above-described elements of Ca, O, and S so that the Py value given by the following relationship is in a range from 1.2 to 3.6. The Py value indicates the forms of inclusions. By adjusting the Py value in a range from 1.2 to 3.6, the detrimental effect on the HIC resistance by the inclusions can be reduced. More preferably, the range of the Py value is from 1.4 to 3.4.

$$Py=\{(Ca)-(130\times(Ca)+0.18)\times(O)\}/(1.25\times(S))1.4\leqq Py\leqq 3.4$$

where Py indicates forms of inclusions (M) indicates the content by mass percent of an element M.

The hot-rolled steel sheet has a composition of the above-described essential elements, the balance being Fe and incidental impurities. In addition to the above-described elements, the hot-rolled steel sheet may contain at least one element selected from the group consisting of Cr, B, and a rare-earth metal (REM) in a range described below, if necessary.

Cr: less than about 0. 1% by mass

Cr is an element improving the corrosion resistance of steel when added in a trace amount. However, the effect is saturated even with a large amount. Accordingly, the Cr content is preferably less than about 0.1% by mass.

B: about 0.003% by mass or less

B is an element effective in imparting high strength and high toughness to steel since it improves the steel hardenability. However, since the effects are saturated when the addition exceeds about 0.003% by mass, the B content is preferably about 0.003% by mass or less.

REM: about 0.005% by mass or less

Similar to Ca, REM has a property of rendering sulfides in steel harmless. However, when the REM content exceeds about 0.005% by mass, toughness and HIC resistance of the steel are reduced due to the influence of REM-based inclusions. Accordingly, the REM content is preferably about 0.005% by mass or less.

When the above-described elements of Cr and/or B are added, the elements of C, Si, Mn, Cu, Cr, Ni, Mo, V, and B preferably satisfy the following Relationship 3, instead of Relationship 1:

$$Px=(C)+(Si)/30+((Mn)+(Cu)+(Cr))/20+(Ni)/60+(Mo)/7+(V)/10+(B)\times 5\leqq 0.17 \quad (3)$$

where (M) indicates the content by mass percent of an element M.

The hot-rolled steel sheet will now be described.

The microstructure of the hot-rolled steel sheet needs to be composed of about 95% by volume or more bainitic ferrite. By the main phase composed of the bainitic ferrite, the steel sheet can be highly strong and highly tough. When the occupancy of the bainitic ferrite exceeds about 95% by volume, the percentages of the hard second phase of, for example, pearlite, bainite or martensite is less than about 5% by volume. Thus, the steel sheet has an excellent HIC resistance. The bainitic ferrite in the invention indicates a ferrite phase generated at a low temperature and having a high dislocation density in grains. This bainitic ferrite apparently differs from soft polygonal ferrite generated at a high temperature.

The hot-rolled steel sheet may be highly strengthened by precipitation strengthening by niobium carbonitride in combination with the above-described means. To achieve the high strength by the precipitation strengthening, a large amount of niobium-carbonitride precipitation is favorable. Preferably, the mass ratio of the Nb precipitation in the steel sheet exceeds about 30% to the total Nb content. However, since a large amount of precipitation of the niobium carbonitride causes a reduction in the steel toughness, the mass ratio of the Nb precipitation in the steel sheet is about 70% or less to the total Nb content. More preferably, the mass ratio is from about 40% to about 60%.

The method for manufacturing the hot-rolled steel sheet will now be described.

A steel slab as a raw material of the hot-rolled steel sheet is preferably manufactured by producing steel having the above-described composition in a converter or the like and then by casting it, for example, by continuous casting in view of production efficiency and slab quality. An electric furnace, other facilities, or other means may also be utilized. Various preliminary treatments or secondary refining such as hot metal treatment, degassing and the like, can be performed, if necessary or desired.

The steel slab manufactured by the above-described process is reheated in a heating furnace, hot-rolled at a finisher delivery temperature of ($Ar_3$ transformation temperature−50° C.) or more, then cooled substantially immediately, coiled into a steel strip at a temperature of about 700° C. or less, and then cooled slowly. An explanation of the conditions will now be described.

Slab reheating temperature (SRT): from about 1,000° C. to about 1,300° C.

The SRT is in a range from about 1,000° C. to about 1,300° C. When the SRT exceeds about 1,300° C., grains coarsen to cause a reduction in toughness of the steel sheet. Such SRT is unfavorable in view of the energy required for reheating. Meanwhile, when SRT is less than about 1,000° C., carbonitride is not re-dissolved in the steel, and strengthening the steel sheet to a required level becomes difficult. Accordingly, the SRT is in the range from about 1,000° C. to about 1,300° C.

Finisher delivery temperature (FDT): ($Ar_3$ transformation temperature−50° C.) or more FDT means the surface temperature of the steel sheet substantially immediately after the steel sheet is finish-rolled. The FDT at hot rolling is ($Ar_3$ transformation temperature−50° C.) or more. When FDT is less than ($Ar_3$ transformation temperature−50° C.), the microstructure of the hot-rolled steel sheet becomes nonuniform, and desired characteristics are not achieved. Meanwhile, when FDT exceeds ($Ar_3$ transformation temperature+100° C.), grains coarsen and toughening of the steel sheet to a desired level becomes difficult. Accordingly, FDT is preferably less than ($Ar_3$ transformation temperature+100° C.). After the finish rolling, the steel sheet needs to be immediately cooled to prevent precipitation of polygonal ferrite and pearlite. "Immediate cooling" and/or "substantially immediate cooling" means cooling which starts within about 10 seconds after finish rolling and is performed at a cooling rate of about 5° C./sec. More preferably, the cooling rate is about 10° C./sec or more.

Coiling temperature (CT): 700° C. or less

The CT of the hot-rolled steel strip is about 700° C. or less. When CT exceeds about 700° C., the microstructure of the steel sheet coarsens, and toughness is significantly reduced. More preferably, CT is about 600° C. or less. To strengthen the steel sheet by precipitation strengthening of Nb and the like, CT is preferably about 400° C. or more. CT according to the invention means the surface temperature of the steel sheet immediately before the steel sheet is coiled by a coiler. The coil is preferably cooled slowly to promote the carbonitride precipitation. "Slow cooling" means spontaneous cooling of the coiled steel strip at normal/room temperatures.

Hot-rolled steel sheets (steel strips) having a thickness exceeding 12.7 mm for high-strength ERW pipes having sour-gas resistance and excellent weld toughness can be produced. These steel sheets are suitable materials for ERW pipes whose grade is X60 or higher defined by API Standard 5L for pipelines of oil and natural gas. Moreover, these steel sheets are applicable to various kinds of high-strength welded steel pipes.

EXAMPLE 1

Steel slabs were manufactured by producing steel having the compositions shown in Table 1 (the balance being Fe and incidental impurities) in a converter, and by casting the steel by continuous casting. These steel slabs were hot-rolled into hot-rolled steel sheets 15.9 mm in thickness under the conditions shown in Table 2. For each of the resultant hot-rolled steel sheets, the occupancy of bainitic ferrite in the steel sheet microstructure and the mass ratio of the Nb precipitation to the total Nb content in the steel sheet were measured by the following procedures. Tensile strength, toughness, and HIC resistance for each of the hot-rolled steel sheets were also determined.

TABLE 1

| | Chemical composition (mass %) | | | | | | | | | | |
|---|---|---|---|---|---|---|---|---|---|---|---|
| Steel | C | Si | Mn | P | S | Al | N | O | Nb | Ti | Ca |
| A | 0.02 | 0.50 | 1.4 | 0.006 | 0.0006 | 0.04 | 0.003 | 0.002 | 0.10 | 0.005 | 0.002 |
| B | 0.06 | 0.05 | 0.6 | 0.010 | 0.0008 | 0.06 | 0.003 | 0.002 | 0.02 | 0.020 | 0.005 |
| C | 0.04 | 0.25 | 1.2 | 0.007 | 0.0006 | 0.03 | 0.002 | 0.003 | 0.05 | 0.015 | 0.004 |
| D | 0.03 | 0.20 | 1.0 | 0.008 | 0.0008 | 0.04 | 0.003 | 0.002 | 0.04 | 0.020 | 0.003 |
| E | 0.05 | 0.30 | 0.8 | 0.008 | 0.0007 | 0.05 | 0.004 | 0.002 | 0.06 | 0.015 | 0.003 |
| F | 0.04 | 0.20 | 1.0 | 0.007 | 0.0004 | 0.04 | 0.003 | 0.001 | 0.08 | 0.010 | 0.001 |
| G | 0.05 | 0.20 | 1.0 | 0.008 | 0.0008 | 0.04 | 0.003 | 0.002 | 0.06 | 0.010 | 0.003 |
| H | 0.08* | 0.10 | 1.0 | 0.007 | 0.0009 | 0.05 | 0.003 | 0.002 | 0.04 | 0.015 | 0.003 |
| I | 0.03 | 0.30 | 1.6* | 0.008 | 0.0006 | 0.02 | 0.003 | 0.002 | 0.05 | 0.010 | 0.003 |
| J | 0.05 | 0.20 | 1.0 | 0.009 | 0.0008 | 0.04 | 0.003 | 0.002 | 0.003* | 0.015 | 0.003 |
| K | 0.06 | 0.40 | 1.4 | 0.008 | 0.0007 | 0.03 | 0.003 | 0.002 | 0.04 | 0.005 | 0.002 |
| L | 0.04 | 0.20 | 1.0 | 0.008 | 0.0009 | 0.04 | 0.003 | 0.002 | 0.04 | 0.010 | 0.002 |
| M | 0.04 | 0.20 | 1.0 | 0.008 | 0.0005 | 0.04 | 0.003 | 0.003 | 0.04 | 0.010 | 0.005 |
| N | 0.06 | 0.10 | 0.6 | 0.010 | 0.0008 | 0.02 | 0.003 | 0.002 | 0.02 | 0.025 | 0.005 |
| O | 0.04 | 0.40 | 1.0 | 0.007 | 0.0004 | 0.08 | 0.003 | 0.001 | 0.08 | 0.010 | 0.001 |

| | Chemical composition (mass %) | | | | | | | | | |
|---|---|---|---|---|---|---|---|---|---|---|
| Steel | V | Cu | Ni | Mo | Cr | B | REM | P*x* | P | Remark |
| A | 0.02 | — | — | — | — | — | — | 0.11 | 1.5 | Example |
| B | — | — | — | 0.50 | 0.05 | — | — | 0.17 | 3.3 | Example |
| C | 0.04 | 0.20 | 0.20 | — | — | — | — | 0.13 | 2.5 | Example |
| D | — | 0.30 | 0.30 | 0.20 | — | — | — | 0.14 | 1.9 | Example |
| E | 0.08 | 0.25 | 0.25 | 0.30 | — | — | — | 0.17 | 2.1 | Example |
| F | 0.06 | — | — | 0.10 | — | 0.002 | 0.003 | 0.13 | 1.4 | Example |
| G | —* | —* | —* | —* | — | — | — | 0.11 | 1.9 | Comparative example |
| H | — | 0.20 | 0.20 | — | — | — | — | 0.15 | 1.7 | Comparative example |

TABLE 1-continued

| | | | | | | | | | | |
|---|---|---|---|---|---|---|---|---|---|---|
| I | — | 0.20 | 0.20 | — | — | — | — | 0.13 | 2.5 | Comparative example |
| J | — | 0.20 | 0.20 | — | | — | — | 0.12 | 1.9 | Comparative example |
| K | — | 0.40 | 0.40 | 0.10 | — | — | — | 0.18* | 1.3 | Comparative example |
| L | 0.05 | — | — | 0.25 | — | — | — | 0.14 | 1.0* | Comparative example |
| M | 0.05 | — | — | 0.25 | — | — | — | 0.14 | 4.0* | Comparative example |
| N | — | — | — | 0.50 | — | — | — | 0.16 | 3.3 | Example |
| O | 0.06 | — | — | 0.10 | — | — | — | 0.12 | 1.4 | Example |

*Outside of the range of the present invention.

Occupancy of Bainitic Ferrite

The occupancy of bainitic ferrite in the microstructure of a steel sheet (volume percent) was determined by taking a micrograph of a section and by measuring the occupied area ratio of the bainitic ferrite according to an image analysis. The section was taken along the rolling direction of the steel sheet at a quarter-width away from an edge of the steel sheet in the steel sheet width direction, and the analyzed point was a quarter-thickness deep from the surface of the steel sheet.

Mass Ratio of Nb Precipitation in Steel Sheet

The mass ratio of Nb precipitation in the steel sheet was determined by measuring the mass of Nb precipitation in the steel sheet by electrolytic-residue analysis and calculating the ratio (%) of this value to the total Nb content. The electrolytic-residue analysis was performed by the following procedure: The steel sheet was electrolyzed in a maleate electrolyte (10% maleic acid-2% acetylacetone-5% tetramethylammonium chloride-methanol) at a low current (about 20 mA/cm$^2$); the residue was collected on a membrane filter (pore size: 0.2 μmf); after the collected residue was ashed, the resultant ash was fused by mixed flux of lithium borate and sodium peroxide; the fusion product was dissolved in hydrochloric acid and then diluted with water; and the precipitation content was determined by inductively coupled plasma (ICP) spectrometry.

Strength of Steel Sheet

Tensile strength (TS) was measured by a tensile test according to American Society for Testing and Materials (ASTM) Standard E8 at room temperature by use of a sheet type specimen having a gauge length of two inches and a parallel-portion width of a half-inch. The test specimen was sampled so that the elongation direction was orthogonal to the rolling direction of the steel sheet.

Toughness

Toughness was determined by a crack-tip-opening displacement (CTOD) test according to ASTM Standard E1290. For a base metal portion of the hot-rolled steel sheet, a test specimen for the CTOD test was sampled so that the longitudinal side of the test specimen was orthogonal to the rolling direction of the steel sheet. For the weld portion, a welded sheet was produced by electric-resistance welding of the hot-rolled steel sheets so that the weld line was parallel to the rolling direction of the steel sheets. From this welded sheet, a test specimen was sampled so that the longitudinal side was orthogonal to the rolling direction of the steel sheets and the weld line was disposed at the center of the test specimen. Each of these specimens was loaded in a three-point bending fixture, and a displacement gauge was placed at the notched portion shown in FIG. 1 provided for the specimen to measure a CTOD. Then, the CTOD of each specimen was measured at a temperature of −10° C. When the CTOD exceeded 0.25 mm, the toughness of the steel sheet was rated as being good.

HIC Resistance

HIC resistance of the steel sheet was determined according to National Association of Corrosion Engineers (NACE) Standard TM0284. For the base metal evaluation, a test specimen was sampled from the hot-rolled steel sheet so that the longitudinal side of the specimen was parallel to the steel sheet. For the weld evaluation, a test specimen was sampled from a welded portion of a welded sheet produced by, similar to the CTOD test specimens, electric-resistance welding so that the longitudinal side of the specimen was parallel to the rolling direction of the steel sheets. After these specimens were immersed in an A solution defined by the above-described standard, the crack-sensitivity ratio (CSR) of each of the specimens was measured. When the CSR shown in Table 2 was 0%, no HIC was observed in the steel sheet and HIC resistance was rated as being good.

Figure 2:
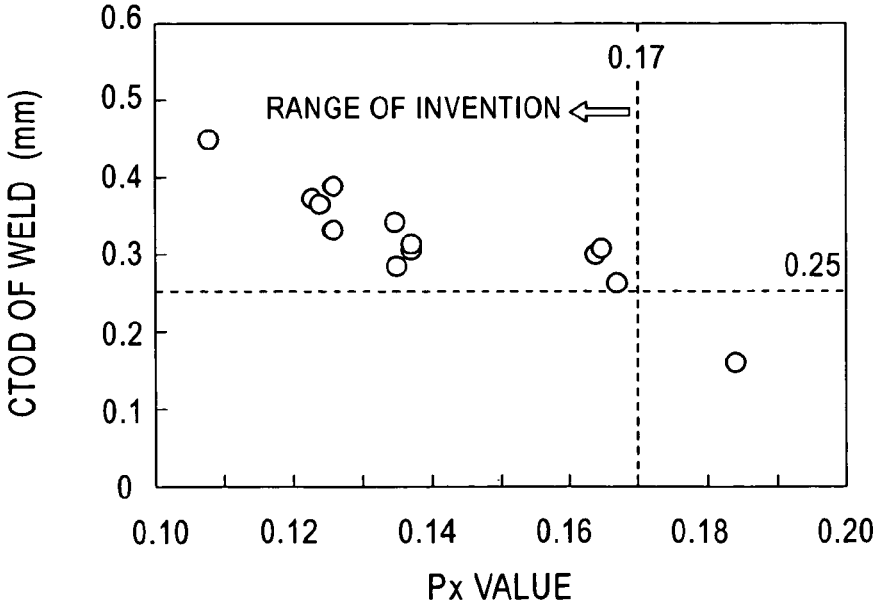
FIG. 2 illustrates the relationship between the Px value of a steel sheet and the CTOD of a weld.
Figure 3:
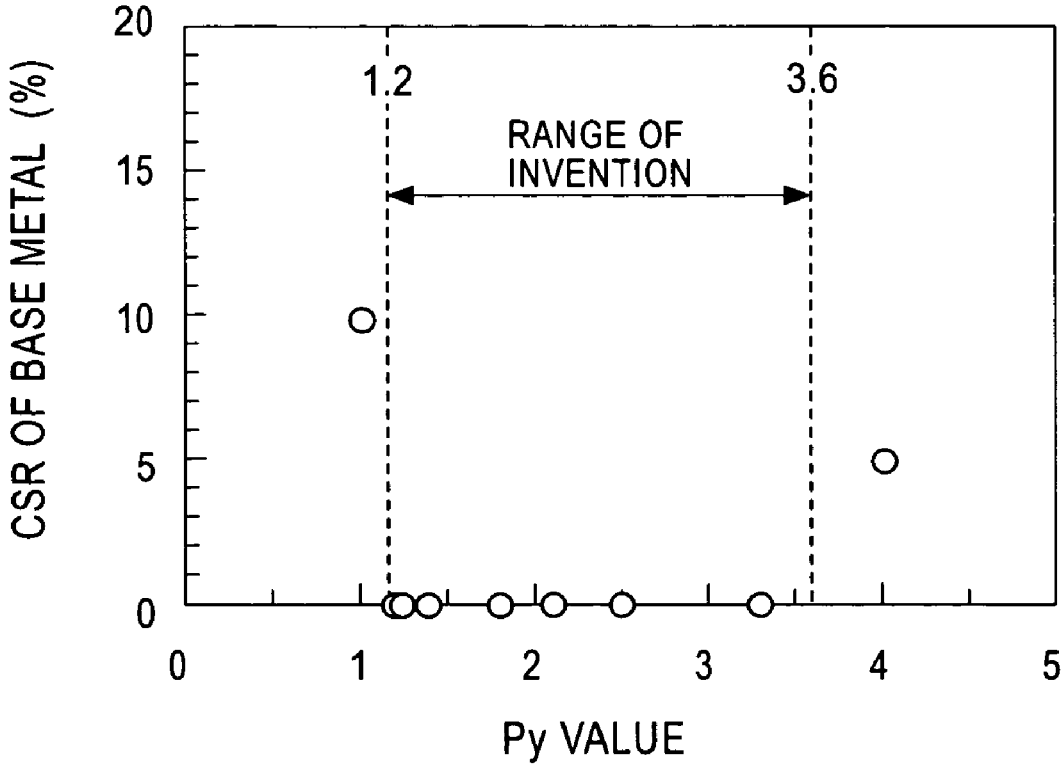
FIG. 3 illustrates the relationship between the Py value of a steel sheet and a crack-sensitivity ratio (CSR) of a base metal.

The results are shown in Table 2. Steel Sheets 1, 3, 4, 6, 8, 10, 12, 13, 21, and 22 had high tensile strength exceeding 517 MPa, excellent toughness both in the base metal and at the welds, and favorable HIC resistance. These hot-rolled steel sheets are suitable materials for high-strength electric-resistance welded (ERW) pipes having sour-gas resistance of Grade X60 or higher defined by American Petroleum Institute (API) Standard 5L. Especially, Steel Sheets 1, 3, 4, 6, 10, 12, 21, and 22 having mass ratios of Nb precipitation from 30% to 70% to the total Nb content had higher tensile strength and superior toughness with the CTODs of the base metals exceeding 0.4 mm. The other steel sheets having compositions or steel microstructures that were outside of our range had a tensile strength of less than 517 MPa or lower toughness or lower HIC resistance. These steel sheets are not suitable for high-strength ERW pipes for use in sour-gas conditions. For each of the steel sheets having contents of each element and steel microstructures that were in our range, the relationship between the Px value and the CTOD of the weld is shown in FIG. 2, and the relationship between the Py value and the CSR of the base metal is shown in FIG. 3. Any of the steel sheets having Px values that were in our range have favorable toughness, and any of the steel sheets having Py values that were in the range of the invention have favorable HIC resistance.

TABLE 2-1

| No. | Steel | $Ar_3$ transformation temp (° C.) | Hot-rolling condition SRT (° C.) | FDT (° C.) | Cooling rate (° C./s) | CT (° C.) | Occupancy of bainitic ferrite (vol. %) | Nb precipitation mass ratio (%) | Tensile strength TS (MPa) | Toughness CTOD of base metal (mm) | CTOD of weld (mm) | HIC resistance CSR of Base metal (%) | CSR of Weld (%) | Remark |
|---|---|---|---|---|---|---|---|---|---|---|---|---|---|---|
| 1 | A | 810 | 1250 | 780 | 15 | 520 | 100 | 55 | 592 | 0.58 | 0.45 | 0 | 0 | Example |
| 2 | A | 810 | 1350* | 780 | 15 | 520 | 100 | 50 | 585 | 0.20 | 0.16 | 0 | 0 | Comp. ex. |
| 3 | B | 770 | 1150 | 780 | 7 | 600 | 96 | 45 | 584 | 0.41 | 0.31 | 0 | 0 | Example |
| 4 | C | 740 | 1200 | 760 | 10 | 560 | 98 | 60 | 568 | 0.48 | 0.36 | 0 | 0 | Example |
| 5 | C | 740 | 950* | 760 | 10 | 560 | 98 | 80 | 520 | 0.32 | 0.26 | 5 | 5 | Comp. ex. |
| 6 | D | 760 | 1200 | 780 | 10 | 560 | 99 | 45 | 572 | 0.40 | 0.34 | 0 | 0 | Example |
| 7 | D | 760 | 1200 | 700* | 10 | 560 | 99 | 55 | 649 | 0.18 | 0.15 | 15 | 20 | Comp. ex. |
| 8 | D | 760 | 1200 | 780 | 10 | 640 | 96 | 75 | 581 | 0.35 | 0.28 | 0 | 0 | Example |
| 9 | D | 760 | 1200 | 740 | 3 | 640 | 90* | 85 | 556 | 0.16 | 0.12 | 20 | 10 | Comp. ex. |
| 10 | E | 770 | 1200 | 780 | 15 | 520 | 97 | 50 | 605 | 0.41 | 0.26 | 0 | 0 | Example |

*Outside of the range of the invention.

TABLE 2-2

| No. | Steel | $Ar_3$ transformation temp (° C.) | Hot-rolling condition SRT (° C.) | FDT (° C.) | Cooling rate (° C./s) | CT (° C.) | Occupancy of bainitic ferrite (vol. %) | Nb precipitation mass ratio (%) | Tensile strength TS (MPa) | Toughness CTOD of base metal (mm) | CTOD of weld (mm) | HIC resistance CSR of base metal (%) | CSR of Weld (%) | Remark |
|---|---|---|---|---|---|---|---|---|---|---|---|---|---|---|
| 11 | E | 770 | 1200 | 780 | 15 | 720* | 0* | 90 | 563 | 0.19 | 0.17 | 20 | 20 | Comp. ex. |
| 12 | F | 760 | 1250 | 780 | 15 | 520 | 97 | 40 | 559 | 0.47 | 0.39 | 0 | 0 | Example |
| 13 | F | 760 | 1250 | 780 | 20 | 360 | 98 | 20 | 528 | 0.42 | 0.33 | 0 | 0 | Example |
| 14 | G* | 740 | 1250 | 760 | 15 | 520 | 95 | 45 | 502 | 0.62 | 0.51 | 0 | 0 | Comp. ex. |
| 15 | H* | 730 | 1200 | 760 | 15 | 520 | 92* | 45 | 628 | 0.23 | 0.19 | 25 | 30 | Comp. ex. |
| 16 | I* | 730 | 1200 | 760 | 15 | 520 | 94* | 50 | 617 | 0.38 | 0.32 | 10 | 10 | Comp. ex. |
| 17 | J* | 740 | 1200 | 760 | 15 | 520 | 97 | 100 | 553 | 0.22 | 0.18 | 0 | 0 | Comp. ex. |
| 18 | K* | 720 | 1200 | 760 | 15 | 520 | 96 | 50 | 576 | 0.32 | 0.16 | 0 | 0 | Comp. ex. |
| 19 | L* | 760 | 1200 | 780 | 15 | 520 | 98 | 55 | 578 | 0.38 | 0.30 | 10 | 10 | Comp. ex. |
| 20 | M* | 760 | 1200 | 80 | 15 | 520 | 98 | 55 | 580 | 0.36 | 0.31 | 5 | 5 | Comp. ex. |
| 21 | N | 760 | 1150 | 780 | 7 | 600 | 95 | 45 | 580 | 0.40 | 0.30 | 0 | 0 | Example |
| 22 | O | 780 | 1250 | 780 | 15 | 520 | 96 | 40 | 555 | 0.45 | 0.37 | 0 | 0 | Example |

*Outside of the range of the invention.

What is claimed is:

1. A hot-rolled steel sheet for a high-strength electric-resistance welded pipe having sour-gas resistance and excellent weld toughness, comprising:

0.03% to about 0.06% C;

about 0.05% to about 0.50% Si;

about 0.5% to about 1.5% Mn;

about 0.010% or less P;

about 0.0010% or less S;

about 0.01% to about 0.10% Al;

about 0.01% to about 0.10% Nb;

about 0.001% to about 0.025% Ti;

about 0.001% to about 0.005% Ca;

about 0.003% or less O;

about 0.005% or less N, about 0.0001% or less B, and at least one element selected from the group consisting of about 0.01% to about 0.10% V; about 0.01% to about 0.50% Cu; about 0.01% to about 0.50% Ni; and about 0.01% to about 0.50% Mo on the basis of mass, wherein C, Si, Mn, Cu, Ni, Mo, and V satisfy Px given by Relationship 1:

$$Px=(C)+(Si)/30+((Mn)+(Cu))/20+(Ni)/60+(Mo)/7+(V)/10\leqq 0.17 \quad (1)$$

where (M) indicates the content by mass percent of an element M;

Ca, O, and S satisfy Py given by Relationship 2:

$$Py=\{(Ca)-(130\times(Ca)+0.18)\times(O)\}/(1.25\times(S))\ 1.2\leqq Py\leqq 3.6 \quad (2)$$

where (M) indicates the content by mass percent of an element M;

the balance is Fe and incidental impurities; and the microstructure of the steel sheet is composed of about 95% by volume or more bainitic ferrite;

the ratio of Nb precipitation in the steel sheet is from about 30% to about 70% by mass with respect to the total Nb content.

2. The hot-rolled steel sheet according to claim 1, further comprising at least one element selected from the group consisting of less than about 0.1% Cr; and about 0.005% or less REM on the basis of mass, wherein the elements of C, Si, Mn, Cu, Cr, Ni, Mo, V, and B satisfy Relationship 3:

$$Px=(C)+(Si)/30+((Mn)+(Cu)+(Cr))/20+(Ni)/60+(Mo)/7+(V)/10+(B)\times 5\leqq 0.17 \quad (3)$$

where (M) indicates the content by mass percent of an element M.

3. A method for manufacturing a hot-rolled steel sheet for a high-strength electric-resistance welded pipe having sour-gas resistance and excellent weld toughness comprising:

reheating a steel slab having the composition according to claim 1 at a temperature from about 1,000° C. to about 1,300° C.;

hot-rolling the slab at a finisher delivery temperature of ($Ar_3$ transformation temperature−50° C.) or more;

substantially immediately cooling the hot-rolled sheet;

coiling the hot-rolled sheet at a temperature of 400° C. to 700° C. to strengthen the steel sheet by precipitation strengthening of Nb; and slowly cooling the coiled sheet.

4. The method according to claim 3, wherein the hot-rolled sheet is cooled within about 10 seconds after finish rolling is performed.

5. The method according to claim 3, wherein the hot-rolled sheet is cooled at a cooling rate of about 5° C./sec or more.

6. A method for manufacturing a hot-rolled steel sheet for a high-strength electric-resistance welded pipe having sour-gas resistance and excellent weld toughness comprising:

reheating a steel slab having the composition according to claim 2 at a temperature from about 1,000° C. to about 1,300° C.;

hot-rolling the slab at a finisher delivery temperature of ($Ar_3$ transformation temperature−50° C.) or more;

substantially immediately cooling the hot-rolled sheet;

coiling the hot-rolled sheet at a temperature of 400° C. to 700° C. to strengthen the steel sheet by precipitation strengthening of Nb; and slowly cooling the coiled sheet.

7. The method according to claim 6, wherein the hot-rolled sheet is cooled within about 10 seconds after finish rolling is performed.

8. The method according to claim 6, wherein the hot-rolled sheet is cooled at a cooling rate of about 5° C./sec or more.

9. The method according to claim 6, having a TS of 517 to 605 MPa.

* * * * *